US007871971B1

(12) United States Patent
Koester et al.

(10) Patent No.: US 7,871,971 B1
(45) Date of Patent: Jan. 18, 2011

(54) MACHINE DISHWASHING RINSE AGENTS AND METHODS OF USING THE SAME

(75) Inventors: Rita Koester, Duesseldorf (DE); Ansgar Behler, Bottrop (DE); Karl-Heinz Schmid, Mettmann (DE); Michael Neuss, Cologne (DE)

(73) Assignee: Cognis IP Management GmbH, Duesseldorf (DE)

( * ) Notice: Subject to any disclaimer, the term of this patent is extended or adjusted under 35 U.S.C. 154(b) by 0 days.

(21) Appl. No.: 09/831,432

(22) PCT Filed: Oct. 30, 1999

(86) PCT No.: PCT/EP99/08289

§ 371 (c)(1),
(2), (4) Date: Jul. 30, 2001

(87) PCT Pub. No.: WO00/27987

PCT Pub. Date: May 18, 2000

(30) Foreign Application Priority Data

Nov. 9, 1998 (DE) ..... 198 51 453

(51) Int. Cl.
*C11D 17/00* (2006.01)

(52) U.S. Cl. ..... 510/218; 510/220; 510/421; 510/499; 510/506

(58) Field of Classification Search ..... 510/421, 510/422, 423, 470, 499, 505, 506, 521, 220
See application file for complete search history.

(56) References Cited

U.S. PATENT DOCUMENTS

| | | | | |
|---|---|---|---|---|
| 1,985,424 | A | | 12/1934 | Piggott |
| 2,016,962 | A | | 10/1935 | Flint et al. |
| 2,703,798 | A | | 3/1955 | Schwartz |
| 3,539,518 | A | | 11/1970 | Feighner et al. |
| 4,624,803 | A | | 11/1986 | Balzer et al. |
| 4,925,587 | A | | 5/1990 | Schenker et al. |
| 5,205,959 | A | | 4/1993 | Schmid et al. |
| 5,602,093 | A | * | 2/1997 | Haerer et al. ..... 510/514 |
| 5,612,305 | A | * | 3/1997 | Lewis ..... 510/220 |
| 5,753,606 | A | | 5/1998 | Hees et al. |
| 5,759,987 | A | | 6/1998 | Haerer et al. |
| 6,008,392 | A | | 12/1999 | Behler et al. |
| 6,156,721 | A | * | 12/2000 | Kwetkat et al. ..... 510/494 |

FOREIGN PATENT DOCUMENTS

| | | | | |
|---|---|---|---|---|
| DE | 37 23 323 | A1 | | 1/1989 |
| DE | 39 14 131 | A1 | | 10/1990 |
| DE | 39 28 600 | A1 | | 3/1991 |
| DE | 39 28 602 | A1 | | 3/1991 |
| DE | 42 25 136 | A1 | | 2/1994 |
| DE | 43 23 252 | A1 | | 1/1995 |
| DE | 43 26 112 | A1 | | 2/1995 |
| DE | 196 11 999 | C1 | | 7/1997 |
| EP | 0 034 039 | A1 | | 8/1981 |
| EP | 0 161 537 | A2 | | 11/1985 |
| EP | 0 197 434 | B1 | | 10/1986 |
| JP | 05-202382 | | * | 8/1993 |
| WO | WO 92/06984 | | | 4/1992 |
| WO | WO 94/13618 | | | 6/1994 |
| WO | WO 96/12001 | | | 4/1996 |

OTHER PUBLICATIONS

"Chemical Abstracts", American Chemical Society, JP 5202382, XP000408014, Columbus, Ohio, (Jan. 24, 1994).
Kelkenberg, "Detergenzien auf Zuckerbasis," Neue Komponenten für Waschrohstoffe und Kosmetika, Tenside Surfactants Detergents, vol. 25, Carl Hanser Verlag, München, 1988, pp. 8-13.

* cited by examiner

*Primary Examiner*—Necholus Ogden, Jr.

(57) ABSTRACT

Rinse agents for machine dishwashing which contain alkoxylated carboxylic acid ester(s), and other optional additives, are described. Methods of rinsing tableware surfaces using the described rinsing agents during machine washing are also described.

16 Claims, No Drawings

MACHINE DISHWASHING RINSE AGENTS AND METHODS OF USING THE SAME

BACKGROUND OF THE INVENTION

Today, tableware washed by machine often has to meet more stringent requirements than tableware washed by hand. Thus, even dishes completely freed from food remains are evaluated as unsatisfactory when, after machine dishwashing, they still show whitish stains which are attributable to water hardness or other mineral salts and which emanate from dried-on water droplets through lack of wetting agents.

Accordingly, in order to obtain sparkling tableware without any stains, rinse agents are now being successfully used. The addition of rinse agents at the end of the wash program ensures that the water drains completely from the tableware so that, at the end of the wash program, the various surfaces are free from residues and sparkling.

Commercially available rinse agents are mixtures of nonionic surfactants, solubilizers (for example cumenesulfonate), organic acids (for example citric acid) and solvents (for example ethanol), water and optionally preservatives and perfumes. The function of the surfactants in these rinse agents is to influence the interfacial tension of the water in such a way that it drains from the tableware in a thin coherent film so that no water droplets, streaks or films remain behind after the subsequent drying phase (so-called wetting effect). Another function of the surfactants is to suppress the foam caused by food residues in the dishwashing machine. Since the rinse agents generally contain acids to improve the clear drying effect, the surfactants used also have to be relatively stable to hydrolysis by acids.

In addition, only biodegradable, toxicologically and dermatologically safe ingredients are now considered for use in rinse agent formulations. Accordingly, the surfactants used in the rinse agents also have to exhibit these properties.

EP-B1 0 197 434 (Henkel) describes rinse agents which contain mixed ethers as nonionic surfactants. Many different materials (glass, metal, silver, plastic, china) are cleaned in dishwashing machines. This range of materials has to be thoroughly wetted in the final rinse cycle. Rinse agent formulations containing mixed ethers as sole surfactant component meet these requirements to only a limited extent, if at all, so that the clear rinse or drying effect is unsatisfactory, particularly on plastic surfaces.

DE-A1 19 611 999 and WO 94/13618 describe alkoxylated carboxylic acid esters which are obtained by homogeneous catalysis in the presence of hydroxides and reducing agents or a co-catalyst. According to both these documents, such compounds may be used in laundry detergents, dishwashing detergents and cleaners.

DE-A-43 26 112 describes low-foaming multipurpose cleaners which contain alkoxylated carboxylic acid esters in admixture with alkyl glycosides and optionally other surfactants, such as alkyl sulfates, alkyl ether sulfates and fatty alcohol polyglycol ethers. These multipurpose cleaners are intended for cleaning hard surfaces, such as clinker bricks, ceramic tiles, enamels, PVC or wooden floors. In contrast to rinse agents, however, multipurpose cleaners always contain anionic surfactants. In addition, multipurpose cleaners, unlike rinse agents, are intended to generate a rich initial foam. Finally, other surfactant concentrations are used in multipurpose cleaners. Accordingly, multipurpose cleaners and rinse agents have to meet different requirements.

The problem addressed by the present invention was to provide new ecologically and toxicologically safe rinse agents which would be at least equivalent to commercially available rinse agents in their performance properties and which would not have any of the disadvantages mentioned above.

BRIEF SUMMARY OF THE INVENTION

The present invention relates, in general, to rinse agents for machine dishwashing containing alkoxylated carboxylic acid esters, particularly those obtained by reaction of carboxylic acid esters and alkylene oxides in the presence of calcined hydrotalcites, and to methods of using the alkoxylated carboxylic acid esters for the production of such rinse agents.

Accordingly, in a first embodiment, the present invention relates to rinse agents for machine dishwashing containing alkoxylated carboxylic acid esters corresponding to formula (I):

$$R^1\underset{\underset{O}{\|}}{C}(OAlk)_nOR^2 \qquad (I)$$

in which $R^1CO$ is an aliphatic acyl group, AlkO stands for $CH_2CH_2O$, $CHCH_3CH_2O$ and/or $CH_2CHCH_3O$, n is a number of 1 to 20 and $R^2$ is an aliphatic alkyl group.

It has surprisingly been found that rinse agents containing alkoxylated carboxylic acid esters and more particularly in admixture with mixed ethers, hydroxy mixed ethers and/or fatty alcohol polypropylene/polyethylene glycol ethers not only show high ecotoxicological compatibility, they also fully satisfy the requirements a commercial product is expected to meet in terms of performance properties. In particular, corresponding rinse agents have an outstanding wetting agent effect and an excellent foam-suppressing effect.

DETAILED DESCRIPTION OF THE INVENTION

Alkoxylated Carboxylic Acid Esters

Alkoxylated carboxylic acid esters, which are a compulsory constituent of the rinse agents according to the invention, are known from the prior art. They may be obtained, for example, by esterification of alkoxylated carboxylic acids with alcohols. For the purposes of the present invention, however, the compounds are produced by reaction of carboxylic acid esters with alkylene oxides using catalysts, more especially calcined hydrotalcite in accordance with DE-A-39 14 131, which give compounds with a narrow homolog distribution. According to the invention, alkoxylated carboxylic acid esters corresponding to general formula (I), in which $R^1CO$ is an aliphatic acyl group containing 6 to 22 carbon atoms, AlkO stands for a $CH_2CH_2O$—, $CHCH_3CH_2O$— and/or $CH_2$—$CHCH_3O$ group, n has an average value of 3 to 20 and $R^2$ is an aliphatic alkyl group containing 1 to 22 carbon atoms, are preferred.

Preferred acyl groups are derived from carboxylic acids containing 6 to 22 carbon atoms of natural or synthetic origin, more especially from linear, saturated and/or unsaturated fatty acids, including the technical mixtures thereof obtainable by lipolysis from animal and/or vegetable fats and oils, for example from coconut oil, palm kernel oil, palm oil, soya oil, sunflower oil, rapeseed oil, cottonseed oil, fish oil, bovine tallow and lard. Examples of such carboxylic acids are caproic acid, caprylic acid, 2-ethyl hexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and/or erucic acid. More particularly, $R^1CO$ is a linear, even-numbered acyl group containing 8 to 18 carbon atoms.

Preferred alkyl groups $R^2$ are derived from primary, aliphatic monohydric alcohols containing 1 to 22 carbon atoms which may be saturated and/or unsaturated. Examples of suitable monoalcohols are methanol, ethanol, propanol, butanol, pentanol and the hydrogenation products of the above-mentioned carboxylic acids containing 6 to 22 carbon atoms. More particularly, $R^2$ is a methyl group.

AlkO preferably stands for a $CH_2CH_2O$ group.

Alkoxylated carboxylic acid esters of formula (I), in which $R^1CO$ is a linear, even-numbered acyl group containing 8 to 18 carbon atoms, AlkO stands for a $CH_2CH_2O$ group, n has an average value of 5 to 15 and $R^2$ is a methyl group, are particularly suitable. Examples of such compounds are carboxylic acid methyl esters alkoxylated with, on average, 5, 7, 9 or 11 moles of ethylene oxide.

If particularly low-viscosity rinse agents are required, it is advisable to use alkoxylated carboxylic acid esters derived from short-chain carboxylic acids, more particularly those containing 8 to 10 carbon atoms. High cleaning performances are obtained with alkoxylated carboxylic acid esters derived from relatively long-chain carboxylic acids, more particularly those containing 12 to 18 carbon atoms.

The alkoxylated carboxylic acid esters may be present as sole nonionic surfactant in the rinse agents, preferably in quantities of 0.5 to 40% by weight and more particularly in quantities of 5 to 35% by weight. However, the alkoxylated carboxylic acid esters are preferably present in the rinse agents in admixture with other nonionic surfactants. Typical examples of suitable other nonionic surfactants are mixed ethers, hydroxy mixed ethers, fatty alcohol polyglycol ethers, alkyl phenol polyglycol ethers, fatty acid amide polyglycol ethers, fatty amine polyglycol ethers, alkoxylated triglycerides, alk(en)yl oligoglycosides, fatty acid-N-alkyl glucamides, protein hydrolyzates (more particularly wheat-based vegetable products), polyol fatty acid esters, sugar esters, sorbitan esters and polysorbates. Where the nonionic surfactants contain polyglycol ether chains, they may have a conventional homolog distribution although they preferably have a narrow homolog distribution. Preferred other nonionic surfactants are fatty alcohol polyglycol ethers, alkyl oligoglucosides, fatty acid-N-alkyl glucamides, hydroxy mixed ethers and/or mixed ethers.

In a preferred embodiment of the invention, the nonionic surfactants used are alkyl and alkenyl oligoglycosides corresponding to formula (II):

$$R^3O\text{-}[G]_p \qquad \text{(II)}$$

in which $R^3$ is an alkyl and/or alkenyl group containing 4 to 22 carbon atoms, G is a sugar unit containing 5 or 6 carbon atoms and p is a number of 1 to 10. They may be obtained by the relevant methods of preparative organic chemistry.

The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (II) indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl group $R^3$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl group $R^3$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut fatty alcohol with a DP of 1 to 3 are preferred.

Another group of preferred other nonionic surfactants are fatty acid-N-alkyl polyhydroxyalkylamides which correspond to formula (III):

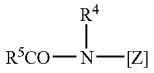

(III)

where $R^5CO$ is an aliphatic acyl group containing 6 to 22 carbon atoms, $R^4$ is an alkyl or hydroxyalkyl group containing 1 to 4 carbon atoms and [Z] is a linear or branched polyhydroxyalkyl group containing 3 to 12 carbon atoms and 3 to 10 hydroxyl groups. The fatty acid-N-alkyl polyhydroxyalkylamides are known compounds which may normally be obtained by reductive amination of a reducing sugar with an alkylamine or an alkanolamine and subsequent acylation with a fatty acid, a fatty acid alkyl ester or a fatty acid chloride. Processes for their production are described in U.S. Pat. No. 1,985,424, in U.S. Pat. No. 2,016,962 and in U.S. Pat. No. 2,703,798 and in International patent application WO 92/06984. An overview of this subject by H. Kelkenberg can be found in Tens. Surf. Det. 25, 8 (1988).

The fatty acid-N-alkyl polyhydroxyalkylamides are preferably derived from reducing sugars containing 5 or 6 carbon atoms, more particularly from glucose. Accordingly, the preferred fatty acid-N-alkyl polyhydroxyalkylamides are fatty acid-N-alkyl glucamides which correspond to formula (IV):

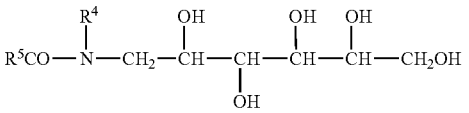

(IV)

Preferred fatty acid-N-alkyl polyhydroxyalkylamides are glucamides corresponding to formula (IV) in which $R^4$ is an alkyl group and $R^6CO$ represents the acyl component of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid or erucic acid or technical mixtures thereof. Fatty acid-N-alkyl glucamides (IV) obtained by reductive amination of glucose with methylamine and subsequent acylation with lauric acid or $C_{12/14}$ cocofatty acid or a corresponding derivative are particularly preferred. In addition, the polyhydroxyalkylamides may also be derived from maltose and palatinose.

Fatty alcohol polyglycol ethers are particularly preferred as the other nonionic surfactants. The fatty alcohol polyglycol ethers are products of the addition of alkylene oxides containing 2 to 4 carbon atoms (ethylene oxide, propylene oxide and/or butylene oxide) onto fatty alcohols containing 6 to 22 carbon atoms. In one embodiment, the fatty alcohol polyglycol ethers are products of the addition of first ethylene oxide and then optionally propylene oxide and/or butylene oxide onto fatty alcohols of the described type. Within this embodiment, particularly suitable fatty alcohol polyethylene glycol/polypropylene or polybutylene glycol ethers are those corresponding to formula (V):

$$R^6O(CH_2CH_2O)_p[MO]_mH \quad (V)$$

in which $R^6$ is an alkyl and/or alkylene group containing 8 to 22 carbon atoms, MO is a propylene oxide and/or a butylene oxide unit, p is a number of 1 to 15 and m is 0 or a number of 1 to 10.

Fatty alcohol polyethylene glycol/polypropylene or polybutylene glycol ethers corresponding to formula (V) may be produced, for example, in accordance with European patent application EP-A2-161 537 or DE-A1 39 28 602 and DE-A1 39 28 600.

Particularly suitable representatives are those of formula (V) in which $R^6$ is an aliphatic, saturated, linear or branched alkyl group containing 8 to 16 carbon atoms, o is a number of 1 to 5 and m=0. These ethers are products of the addition of 1 to 5 moles ethylene oxide onto monohydric alcohols. Suitable monohydric alcohols are the so-called fatty alcohols, such as caproic, caprylic, lauryl, myristyl and stearyl alcohol and the technical mixtures thereof obtained in the high-pressure hydrogenation of technical methyl esters based on fats and oils. Examples of monohydric branched alcohols are the so-called oxo alcohols which generally carry 2 to 4 methyl groups as branches and are produced by the oxo process and so-called Guerbet alcohols which are branched in the 2-position by an alkyl group. Suitable Guerbet alcohols are 2-ethyl hexanol, 2-butyl octanol, 2-hexyl decanol and/or 2-octyl dodecanol.

Other suitable compounds of formula (V) are those in which $R^6$ is an aliphatic, saturated, linear or branched alkyl group containing 8 to 16 carbon atoms, o is a number of 2 to 7 and m is a number of 3 to 7. These compounds are addition products of monohydric alcohols of the described type alkoxylated first with 2 to 7 moles ethylene oxide and then with 3 to 7 moles propylene and/or butylene oxide.

In another preferred embodiment, the rinse agents contain fatty alcohol polyglycol ethers which are products of the addition of first propylene oxide and then optionally ethylene oxide. Accordingly, the ethers in question are fatty alcohol polypropylene glycol/polyethylene glycol ethers which preferably correspond to formula (VI):

$$R^7O[CH_2(CH_3)CHO]_r(CH_2CH_2O)_qH \quad (VI)$$

in which $R^7$ is an alkyl and/or alkenyl group containing 8 to 22 carbon atoms, r is a number of 1 to 10 and q is a number of 0 to 15.

Compounds such as these are described, for example, in DE-A1 43 23 252. Particularly preferred representatives of the compounds corresponding to formula (VI) are those in which $R^7$ is an aliphatic, saturated, linear or branched alkyl chain containing 8 to 16 carbon atoms, r is a number of 1 to 5 and q is a number of 1 to 6. These compounds are preferably products of the addition of 1 to 5 moles propylene oxide and 1 to 6 moles ethylene oxide onto monohydric alcohols of the type already described.

Particularly preferred other nonionic surfactants also include the so-called mixed ethers. The mixed ethers are products of the addition of ethylene oxide and/or propylene oxide onto fatty alcohols which are end-capped by subsequent reaction with an alkyl chloride in the presence of bases. Particularly suitable mixed ethers are those which have been produced by end-capping with an alkyl halide containing 1 to 8 carbon atoms and more particularly with 1 to 4 carbon atoms of the fatty alcohol polyglycol ethers corresponding to formula (V) and/or (VI). Typical examples are mixed ethers based on a technical $C_{12/18}$ or $C_{12/14}$ cocoalcohol onto which 5 to 10 moles of ethylene oxide have been added and which have been end-capped with a methyl group or with a butyl group, for example Dehypon® LS-54, LS-104, LT-54, LS-104, LS-531, Henkel KGaA, Düsseldorf/FRG).

Other particularly preferred nonionic surfactants are so-called hydroxy mixed ethers which have been produced by reaction of 1,2-epoxyalkanes with mono-, di- and/or polyhydric alkoxylated alcohols. Preferred hydroxy mixed ethers correspond to formula (VII):

$$R^8O[CH_2CH(CH_3)O]_x(CH_2CHR^9O)_y[CH_2CH(OH)R^{10}]_z \quad (VII)$$

in which $R^8$ is an alkyl and/or alkylene group containing 4 to 18 carbon atoms, $R^9$ is hydrogen or a methyl or ethyl group, $R^{10}$ is an alkyl group containing 2 to 22 carbon atoms, x is 0 or a number of 1 to 10, y is a number of 1 to 30 and z is the number 1.

Hydroxy mixed ethers corresponding to formula (VII) are known from the literature and are described, for example, in WO 96/12001. They are produced by reaction of 1,2-epoxyalkanes ($R^{10}CHOCH_2$) with monohydric alkoxylated alcohols. According to the invention, hydroxy mixed ethers derived from alkoxylates of monohydric alcohols (z=1) with the formula $R^8$—OH are preferred. Suitable examples of alcohols have already been given in connection with the fatty alcohol polyglycol ethers.

The alcohols are used in the form of their alkoxylates which are produced in known manner by reaction of the alcohols with ethylene oxide, propylene oxide and/or butylene oxide. Alkoxylates of alcohols which have been alkoxylated with 10 to 25 moles of ethylene oxide ($R^9$=hydrogen, x=0, y=10 to 25) or with 1 to 3 moles of propylene oxide and then with 10 to 25 moles of ethylene oxide ($R^9$=hydrogen, x=1 to 3, y=10 to 25) are preferably used.

Most particularly suitable hydroxy mixed ethers corresponding to formula (VII) are those in which $R^8$ is a saturated linear alkyl chain containing 8 to 14 carbon atoms, $R^9$ is hydrogen, $R^{10}$ is a saturated linear alkyl chain containing 8 to 12 carbon atoms, x is 0 or a number of 1 to 3, y is a number of 10 to 25 and z is the number 1. Hydroxy mixed ethers such as these are described in detail in DE-A1 37 23 323.

The rinse agents according to the invention may contain the alkoxylated carboxylic acid esters and the other nonionic surfactants, more particularly the mixed ethers, hydroxy mixed ethers and the fatty alcohol polyglycol ethers in a ratio by weight of 10:90 to 80:20 and more particularly 30:70 to 40:60. The ratio by weight of the other nonionic surfactants to one another is less critical.

Besides the surfactants already described, the rinse agent formulations according to the invention contain mono- and/or polybasic carboxylic acids, preferably hydroxycarboxylic acids, as their most important additives. Typical examples are malic acid (monohydroxy-succinic acid), tartaric acid (dihydroxysuccinic acid), saturated aliphatic dicarboxylic acids, such as oxalic acid, malonic acid, succinic acid, glutaric acid, adipic acid, gluconic acid (hexanepentahydroxy-1-carboxylic acid), but preferably water-free citric acid. They may be used in the rinse agents in quantities of about 1 to 50% by weight and preferably in quantities of about 5 to 30% by weight. Suitable other additives are, above all, dyes and perfumes and preservatives, preferably in quantities of 0 to 1% by weight. If desired, the rinse agents may additionally contain solubilizers or hydrotropes. A suitable solubilizer is cumene sulfonate in quantities of 0 to 25% by weight and more particularly in quantities of 0.2 to 15% by weight, expressed as active substance. Recommended hydrotropes are ethanol and/or isopropanol in quantities of 0 to 25% by weight. The balance to 100% by weight is water.

COMMERCIAL APPLICATIONS

The rinse agents according to the invention contain ecotoxicologically particularly safe ingredients, show excellent wetting behavior on various materials and excellent foam-suppressing behavior.

The present invention also relates to the use of alkoxylated carboxylic acid esters as a surfactant for the production of rinse agents for machine dishwashing.

The alkoxylated carboxylic acid esters used show excellent solubility in water without passing through a gel phase. The rinse agents may be used both in the domestic sector and in the institutional sector.

EXAMPLES

Rinse agents with the compositions shown in Table 1 (% by weight, based on active substance) were prepared and tested for their clear rinse effect. The clear rinse effect was visually evaluated on the basis of the lime stains observed on glasses, cutlery and plates after they had been cleaned in a commercially available domestic dishwasher at 65° C. The domestic dishwasher was filled with the rinse agents according to the invention and with a comparison formulation (=standard).

If at least 4 out of 5 people visually evaluated a relatively small number of lime stains, the clear rinse effect was judged to be "better than standard". The results are set out in Table 1.

TABLE 1

Rinse agent formulations

| Ingredients | Standard | Ex. 1 | Ex. 2 | Ex. 3 | Ex. 4 |
|---|---|---|---|---|---|
| $C_{8/18}CO(EO)_{10}CH_3$[a] | — | 15 | 2.0 | 5.0 | 5.0 |
| Hydroxy mixed ether[b] | — | — | 5.0 | 10.0 | — |
| $C_{12/14}$ FA + 5EO + 4PO[c] | 15.0 | — | 8.0 | — | 10.0 |
| Cumenesulfonate | 8.0 | 5.0 | 3.0 | 2.0 | 5.0 |
| Citric acid | 5.0 | 5.0 | 5.0 | 5.0 | 5.0 |
| | | to 100% by weight water | | | |
| Clear rinse effect | + | Better than standard | Better than standard | Better than standard | Better than standard |

[a] $C_{8/18}CO(EO)_{10}CH_3$ = $C_{8/18}$ fatty acid methyl ester ethoxylated with 10 moles ethylene oxide (EO)

[b] Hydroxy mixed ether = $C_{8/10}$ alcohol cut + 1PO + 22 EO epoxidized with α-decene epoxide

[c] $C_{12/14}$ FA + 5EO + 4PO = $C_{12/14}$ alcohol cut ethoxylated with 5 moles EO and 4 moles propylene oxide (PO)

What is claimed is:

1. A method of rinsing machine-washed tableware materials, said method comprising:

(a) providing a rinse agent comprising (i) an alkoxylated carboxylic acid ester with a narrow homolog distribution of a formula:

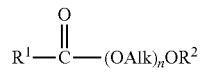

(I)

wherein $R^1C(O)$ represents an aliphatic acyl group, each AlkO independently represents an alkoxylate selected from the group consisting of $CH_2CH_2O$, $CHCH_3CH_2O$ and $CH_2CHCH_3O$, n is a number of from 1 to 20, and $R^2$ represents an aliphatic alkyl group and optionally (ii) an additional nonionic surfactant selected from the group consisting of fatty alcohol polyglycol ethers, alk(en)yl oligoglycosides, fatty acid-N-alkyl glucamides, hydroxy mixed ethers, mixed ethers, and mixtures thereof; and (b) contacting a tableware material surface with the rinse agent during machine washing of the tableware material surface.

2. The method according to claim 1, wherein each AlkO represents a $CH_2CH_2O$, $R^2$ represents a methyl group, and n is a number of from 5 to 15.

3. The method according to claim 1, wherein the alkoxylated carboxylic acid ester is prepared by reacting a carboxylic acid ester and an alkylene oxide in the presence of calcined hydrotalcite.

4. The method according to claim 1, wherein the alkoxylated carboxylic acid ester is present in the rinse agent in an amount of from 0.5 to 40% by weight.

5. The method according to claim 1, wherein the additional nonionic surfactant is present and comprises an alk(en)yl oligoglycoside of a formula:

$$R^3O\text{-}[G]_p \quad \text{(II)}$$

wherein $R^3$ represents an alkyl or alkenyl group having from 4 to 22 carbon atoms, each G independently represents a sugar unit containing 5 or 6 carbon atoms and p represents a number of from 1 to 10.

6. The method according to claim 1, wherein the additional nonionic surfactant is present and comprises a fatty acid-N-alkyl polyhydroxy alkylamide of a formula:

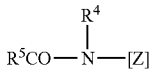

(III)

wherein $R^5CO$ represents an aliphatic acyl group having from 6 to 22 carbon atoms, $R^4$ represents an alkyl or hydroxyalkyl group having from 1 to 4 carbon atoms, and [Z] represents a linear or branched polyhydroxyalkyl group having from 3 to 12 carbon atoms and from 3 to 10 hydroxyl groups.

7. The method according to claim 1, wherein the additional nonionic surfactant is present and comprises a fatty alcohol poly(alkylene)glycol ether of a formula:

$$R^6O(CH_2CH_2O)_p[MO]_mH \quad \text{(V)}$$

wherein $R^6$ represents an alk(en)yl group having from 8 to 22 carbon atoms, each MO independently represents an alkoxide selected from the group consisting of propylene oxide and butylene oxide, p is a number of from 1 to 15 and m is a number of from 0 to 10.

8. The method according to claim 1, wherein the additional nonionic surfactant is present and comprises a fatty alcohol polyalkylene glycol ether of a formula:

$$R^7O[CH_2(CH_3)CHO]_r(CH_2CH_2O)_qH \quad \text{(VI)}$$

wherein $R^7$ represents an alk(en)yl group having from 8 to 22 carbon atoms, r is a number of from 1 to 10 and q is a number of from 0 to 15.

9. The method according to claim 1, wherein the additional nonionic surfactant is present and comprises a hydroxy mixed ether of a formula:

$$R^8O[CH_2CH(CH_3)O]_x(CH_2CHR^9O)_y[CH_2CH(OH)R^{10}]_z \quad \text{(VII)}$$

wherein $R^8$ represents an alk(en)yl group having from 4 to 18 carbon atoms, each $R^9$ independently represents a hydrogen or a methyl or ethyl group, each $R^{10}$ independently represents an alkyl group having from 2 to 22 carbon atoms, x is a number of from 0 to 10, y is a number of from 1 to 30 and z is the number 1.

10. The method according to claim 1, wherein the alkoxylated carboxylic acid ester and the additional nonionic surfactant are present in the rinse agent in a ratio by weight of from 10:90 to 80:20.

11. The method according to claim 1, wherein the rinse agent further comprises an acid selected from the group consisting of monocarboxylic acids, polycarboxylic acids, and mixtures thereof.

12. The method according to claim 11, wherein the acid is present in an amount of from 1 to 50% by weight.

13. The method according to claim 5, wherein the rinse agent further comprises an acid selected from the group consisting of monocarboxylic acids, polycarboxylic acids, and mixtures thereof.

14. The method according to claim 13, wherein the acid is present in an amount of from 1 to 50% by weight.

15. The method according to claim 6, wherein the rinse agent further comprises an acid selected from the group consisting of monocarboxylic acids, polycarboxylic acids, and mixtures thereof.

16. The method according to claim 15, wherein the acid is present in an amount of from 1 to 50% by weight.

* * * * *